US007992676B1

(12) United States Patent
Desjardins et al.

(10) Patent No.: US 7,992,676 B1
(45) Date of Patent: Aug. 9, 2011

(54) COMPACT TUNED ACOUSTIC ATTENUATION DEVICE

(75) Inventors: Michael Desjardins, Kalamazoo, MI (US); Keat Boon Mah, Portage, MI (US)

(73) Assignee: Mann & Hummel GmbH, Ludwigsborg (DE)

( * ) Notice: Subject to any disclaimer, the term of this patent is extended or adjusted under 35 U.S.C. 154(b) by 0 days.

(21) Appl. No.: 12/841,043

(22) Filed: Jul. 21, 2010

(51) Int. Cl.

| | |
|---|---|
| ***F02M 35/00*** | (2006.01) |
| ***F02M 35/10*** | (2006.01) |
| ***F02B 27/02*** | (2006.01) |
| ***F01N 1/02*** | (2006.01) |
| ***F01N 1/08*** | (2006.01) |
| ***F01N 13/08*** | (2010.01) |
| ***F01N 13/18*** | (2010.01) |
| ***B63B 17/00*** | (2006.01) |

(52) U.S. Cl. ..... 181/229; 181/248; 181/250; 181/272; 181/273; 181/282; 60/312; 114/363; 123/184.57

(58) Field of Classification Search ..... 181/229, 181/248, 250, 272, 273, 282; 60/312; 114/363; 123/184.57

See application file for complete search history.

(56) References Cited

U.S. PATENT DOCUMENTS

| | | | | |
|---|---|---|---|---|
| 3,920,095 | A * | 11/1975 | Clark | 181/248 |
| 3,955,643 | A * | 5/1976 | Clark | 181/248 |
| 4,371,054 | A * | 2/1983 | Wirt | 181/252 |
| 5,004,069 | A * | 4/1991 | Van Blaircum et al. | 181/282 |
| 5,735,229 | A * | 4/1998 | House et al. | 114/363 |
| 5,979,598 | A * | 11/1999 | Wolf et al. | 181/272 |
| 6,009,705 | A * | 1/2000 | Arnott et al. | 60/312 |
| 7,708,113 | B1 * | 5/2010 | Prior | 181/229 |
| 7,810,609 | B2 * | 10/2010 | Sikes et al. | 181/250 |
| 2009/0242323 | A1 * | 10/2009 | Densmore et al. | 181/229 |

* cited by examiner

*Primary Examiner* — Elvin G Enad
*Assistant Examiner* — Christina Russell
(74) *Attorney, Agent, or Firm* — James Hasselbeck

(57) ABSTRACT

A tuned acoustic attenuation device includes a housing defining a chamber within with air inlet and outlet channels opening into the chamber. An acoustic chamber or chambers are arranged on an exterior wall of or alternately within the housing and positioned to extend in a substantially lateral parallel relationship to the inlet or outlet channel and are configured as quarter wave tuners. The acoustic chambers may be realized within the housing by adapting housing stiffening support ribs of the housing. The acoustic attenuation characteristics of individual acoustic chambers cooperate to broaden the sound attenuation bandwidth or increase the attenuation at selected noise frequencies.

8 Claims, 3 Drawing Sheets

COMPACT TUNED ACOUSTIC ATTENUATION DEVICE

TECHNICAL FIELD

The disclosure relates to acoustic tuning and sound attenuation devices and, more particularly, to compact broadband acoustic attenuation devices for an engine air induction system.

BACKGROUND OF THE INVENTION

Motor vehicles include an air intake system configured to provide measured quantities of filtered outside air to the internal combustion engine. The outside air is drawn in through an air filtration system, possibly continuing through a throttle body and delivered to the air intake manifold of the engine. The operation of the internal combustion engine with its air intake, fuel combustion and exhaust cycles taken together with the opening/closing operation of the air intake valves presents a problematic source of unwanted noise generation within the air intake tract. This internal combustion engine originated noise may travel in a direction opposing intake air flow back through the air intake tract to radiate from an intake end of the air intake tract or to potentially radiate through the walls of the air intake tract by the sympathetic vibration of the intake tract walls in response to pressure variations (sound pressure variations) within the intake tract.

The engine generated noise in the air intake tract may occur over a wide range of frequencies with the particular sound frequency spectrum depending upon the operating parameters of the engine, such as engine RPMs and engine load, for example. This noise present in the air intake tract within the engine compartment may find its way into the passenger compartment of the vehicle by various paths, for example, through the intervening firewall, through the floor panels or through open vehicle windows. The air intake tract noise, when it reaches the passenger compartment, may be experienced as a nuisance, or even as an indication of poor vehicle design and poor quality.

It is known to treat engine noise in the air intake tract by providing one or more resonator chambers such as, for example, Helmholtz resonators, connected into the air intake tract. While such solutions are known to be beneficial in attenuating intake tract noise, the additional components add expense, intake system complexity and required addition under hood space to install and integrate the components with the air intake system.

It is a known problem that motor vehicle engine compartments must provide space for and integrate a variety of engine associated components including batteries, alternator, air conditioning compressor and heat exchangers, engine coolant systems, transmission, as well as the air intake system and air filtration system for the engine. With the increasing trend towards smaller, lighter, more fuel efficient vehicles and the resulting reduced engine compartment space, the limited packaging space for air intake components and acoustic treatment devices is becoming ever more scarce and valuable. It is also known that providing space under the hood to integrate sound treatment devices may not be a high priority for vehicle designs and engineers, particularly when the need for sound treatment is not identified until late in the vehicle design and build cycle. At a later point in the vehicle design the available packaging space under the hood is what it is and cannot be readily changed to accommodate new components.

Therefore, there remains a need in the art for a compact tuned acoustic attenuation device that requires a minimal of installation space and is easily integrated into the available under hood space. Additionally, there remains a need for a tuned acoustic attenuation device that is operable in a single compact device to provide broadband noise attenuation over a selected range of frequencies.

SUMMARY OF THE INVENTION

In various aspects of the invention, a compact tuned acoustic attenuation device is configured and adapted to attenuate selected/predetermined noise frequencies within the air intake tract of an internal combustion engine. In various aspects of the invention, the compact acoustic attenuation device includes a housing enclosure defining a housing air chamber within. The housing includes a tubular air inlet channel arranged on and extending through a first end wall of the housing and opening into the air chamber. An air outlet channel is provided through an opposing second wall of the housing with an open mouth of the outlet channel positioned to substantially face the open mouth of the inlet channel but with the open ends spaced apart to form an air gap therebetween. The air inlet channel and/or the air outlet channels may have any variety of tubular shape cross sections, including circular, rectangular, elliptical or other shapes.

The acoustic chamber or chambers are operative to attenuate sound and are arranged on an exterior wall of or alternately within the housing and positioned to extend in a substantially lateral parallel relationship to the inlet channel. The acoustic chambers are each enclosed by circumferentially closed sidewalls and an acoustically reflective bottom wall with each acoustic chamber having an open-end portion. The open ends of each acoustic chamber are arranged to face the gap and are in airflow communication with the outlet channel such as to receive and attenuate by phase shift reflection noise in the outlet channel. Each of the acoustic chambers has at least one of its volume and depth selected to provide a desired acoustic attenuation characteristic at a selected frequency and bandwidth of noise. The acoustic chambers are preferably configured to operate as quarter wave tuners.

In additional aspects of the inventions adapting housing stiffening support ribs provided within the housing integrally forms the acoustic chambers in the interior of the housing.

In further aspects of the invention, at least some of the acoustic chambers have a volume and depth selected to provide acoustic attenuation at the same or a differing selected frequency and bandwidth relative to other acoustic chambers. The acoustic attenuation characteristics of the acoustic chambers cooperate to broaden the sound attenuation bandwidth or increase the attenuation at selected frequencies so as to selectively characterize sound in said acoustic attenuation device.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
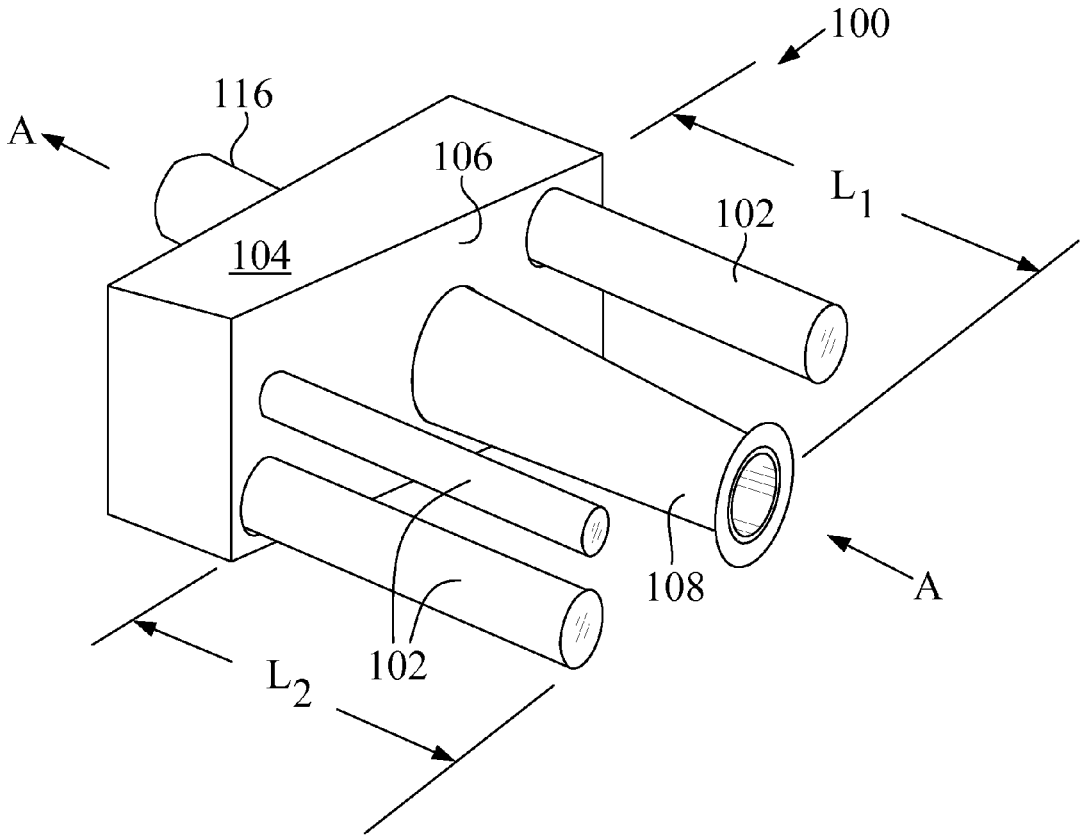
FIG. 1 schematically illustrates a tuned acoustic attenuation device having a plurality of tuned acoustic chambers arranged on an air box enclosure, illustrating various characteristics of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to a compact tuned acoustic attenuation device for the air intake tract of an internal combustion engine. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Various embodiments of the invention may be applied to attenuate selected frequencies of noise within to the air induction system of an internal combustion engine, such as for example, a motor vehicle, a stationary engine or other internal combustion engine applications.

Various embodiments according to the present invention have an air induction system including an intake air passage delivering combustion air to an internal combustion engine. Positioned along this passage is a housing or enclosure defining a chamber within with the chamber provided in air flow communication with the interior of the intake air passage.

Although the enclosure or housing may be provided with a single connection or with a single branch connection to the air intake passage, it is preferred that the housing and chamber be configured in a flow-through configuration wherein the intake air flow enters the housing chamber through an air inlet channel arranged at one end face of the housing, flows through the housing and exits through and air outlet channel arranged at an opposing end face of the housing as this permits the sound pressure waves to impact face on with the acoustic chambers providing more efficient acoustic attenuation.

The housing serves as a support member into which are defined or onto which are externally mounted or arranged one or more acoustic attenuation chambers. The acoustic attenuation chambers are each characterized with closed sidewalls and a closed bottom wall with an open end provided opposite the bottom to define an acoustic air volume therein. The open end of the acoustic chambers is configured and arranged to place each acoustic chamber in air flow configuration with the air chamber defined within the housing or enclosure.

The acoustic chambers according to the present inventive disclosure are preferably configured as tuned quarter wave acoustic chambers. Quarter wave chambers are known in the art and generally characterized as elongated tubular structures configured with one open end and an axially opposing closed end which is substantially rigid so as to be effective at reflecting sound waves. Such quarter wave chambers are generally uniform in their cross section along their axial length. A sound pressure wave entering the open end of such an acoustic chamber will travel to the closed end of the chamber and then reflect back to the open end of the chamber. If the reflected wave arrives at the open end of the chamber essentially 180 degrees out of phase with a subsequent incoming sound pressure wave at the acoustic chambers open end then these out of phase sound pressure waves will interfere with each other and due to their oppositely signed magnitudes will tend to cancel each other, thereby resulting in a maximal attenuation in the magnitude of the sound at that particular frequency. This 180 degree out of phase interference occurs when the frequency of the sound wave is such that its wavelength is 4 times the length of the acoustic chamber from its open end to its closed bottom. To say this another way, the acoustic chamber has an overall length from its open end to its end closed end of one quarter of the wavelength of its tuned noise attenuation frequency. Although such quarter wave acoustic chambers can produce a significant degree of noise attenuation when properly configured, the attenuation is limited to a narrow band of frequencies around its tuned frequency.

According to various aspects of the inventions, preferably the acoustic chambers are arranged such that they are positioned substantially in a lateral parallel relationship to each other and to the air inlet channel. By lateral parallel, we mean that the acoustic chambers and the air inlet channel (or air outlet channel) are positioned essentially side by side and share a common alignment direction, where the side by side arrangement is such that the acoustic chambers and the air inlet channel or air outlet channel are displaced laterally with sidewalls facing.

In a preferred embodiment, the acoustic chambers are positioned at a side of the housing chamber located opposite to or across from the location where the air outlet channel opens into the housing.

In an alternate embodiment, at least some of the acoustic chambers are positioned at a side of the housing chamber located opposite to or across from the location where the air inlet channel opens into the housing. In this embodiment other acoustic chambers may be arranged opposite to or across from the location where the air outlet channel opens into the housing.

As engine generated noise in the intake tract travels backwards through the intake tract, the engine noise enters the acoustic attenuation device housing through the air outlet channel. Therefore, to best provide the 180 degree out of phase noise cancellation effect, preferably the open end of each acoustic chamber is generally aligned, although not necessarily perfectly aligned, to face the mouth where the air outlet channel enters the housing chamber. This alignment permits air pressure pulsations entering the housing from the engine through the air outlet channel to propagate in the housing in a direction towards and impinging upon in the acoustic chambers and then to reflect from the closed bottom of each acoustic chamber.

The acoustic chambers may generally have a width that is less than their length wherein the length of each acoustic attenuation channel is taken from its open end to its opposing closed bottom and is preferably aligned in parallel with the air flow entering the inlet channel and leaving through the outlet channel.

The individual acoustic chambers may be tuned to a shared frequency or to overlapping frequencies to provide an enhanced intake noise attenuation around a target frequency, or certain ones of the acoustic chambers may be selectively tuned to more widely spaced frequencies to provide a broadband noise attenuation characteristic with attenuation peaks occurring in neighborhoods around more widely spaced frequencies.

Advantageously, the present invention's tunable (by chamber dimensional configuration) noise attenuation characteristics and the compact packaging volume of the acoustic attenuation device provides for a minimum weight, simple design and an easy flow-through installation into an air induction system, providing a compact solution to an intake tract noise problem.

To minimize the transmission of intake tract noise into the exterior environment it is preferred that the components comprising the acoustic attenuation device have exterior walls of sufficient strength such that they are substantially rigid and not prone to defecting under the influence of air pressure pulsations within the intake tract. Such substantially rigid walls are more prone to internally reflect sound waves within the air acoustic attenuation device than to radiate intake tract sound through the exterior walls of the device to the environment.

Preferably the components of the acoustic attenuation device, particularly the acoustic chambers and the housing on which the chambers are formed or mounted, are made of, for example, a molded plastic resin material. The size and shape of the housing with its interior chamber and the size or cross section and configuration of the inlet and outlet channels are configured to meet the air flow and pressure drop requirements of the air induction system application. For motor vehicle installations the configuration of the acoustic attenuation device must meet the packaging constraints for installation into the intended engine compartment space.

The discussion now continues with reference to the provided drawings. FIG. 1 schematically illustrates a tuned acoustic attenuation device 100 having a plurality of tuned tubular acoustic chambers 102 arranged on an end wall 106 of an air box enclosure 104 wherein the acoustic chambers are arranged external to the air box enclosure. Also arranged on end wall 106 is an air inlet channel 108. In FIG. 1 the air inlet channel 108 and air outlet channel 116 share a substantially common axial alignment such that the inlet channel 108 and outlet channel 116 air open at opposing walls of the air box 104. In other embodiments, the inlet channel 108 and outlet channel 116 may have differing angular alignments. For example, in an alternate embodiment the air inlet channel may be aligned, for example, at 90 degrees relative to the air outlet channel by arranging the air inlet channel on the top wall of the air box housing 104 (by top wall we refer to the air box housing 104 wall on which the reference label "104" is written on FIG. 1. Generally the air inlet channel and air outlet channel may be arranged on any wall of the air box housing 104 without regard to a common axial alignment.

An air outlet channel 116 is arranged on an opposing end wall of the air box housing 104 such that air flow generally occurs in the direction of arrows "A". The air box housing 104 defines an intermediate air chamber (open interior of housing 104) between the air inlet channel 108 and the air outlet channel 116, with the intermediate air chamber in air flow communication with the air inlet channel 108, open ends of the acoustic chambers 102 and the air outlet channel 116.

Conceptually, each acoustic chamber 102 is preferably configured to act as quarter wave tuner operative to attenuate sound in the neighborhood of a selected tuned frequency. Various acoustic chambers 102 on the housing 104 preferably may be provided with differing or staggered tuned frequencies such that a relatively broadband frequency attenuation characteristic may be achieved for the acoustic attenuation device 100 over a range of frequencies.

Preferably the inlet channel 108 has an axially arranged length L1 that substantially matches the length L2 of at least a portion of the acoustic chambers 102. Each of the acoustic chambers may be configured with an internal air volume and an internal chamber depth (or length) to tune the acoustic chamber to a desired tuned frequency as discussed earlier above.

Figure 2A:
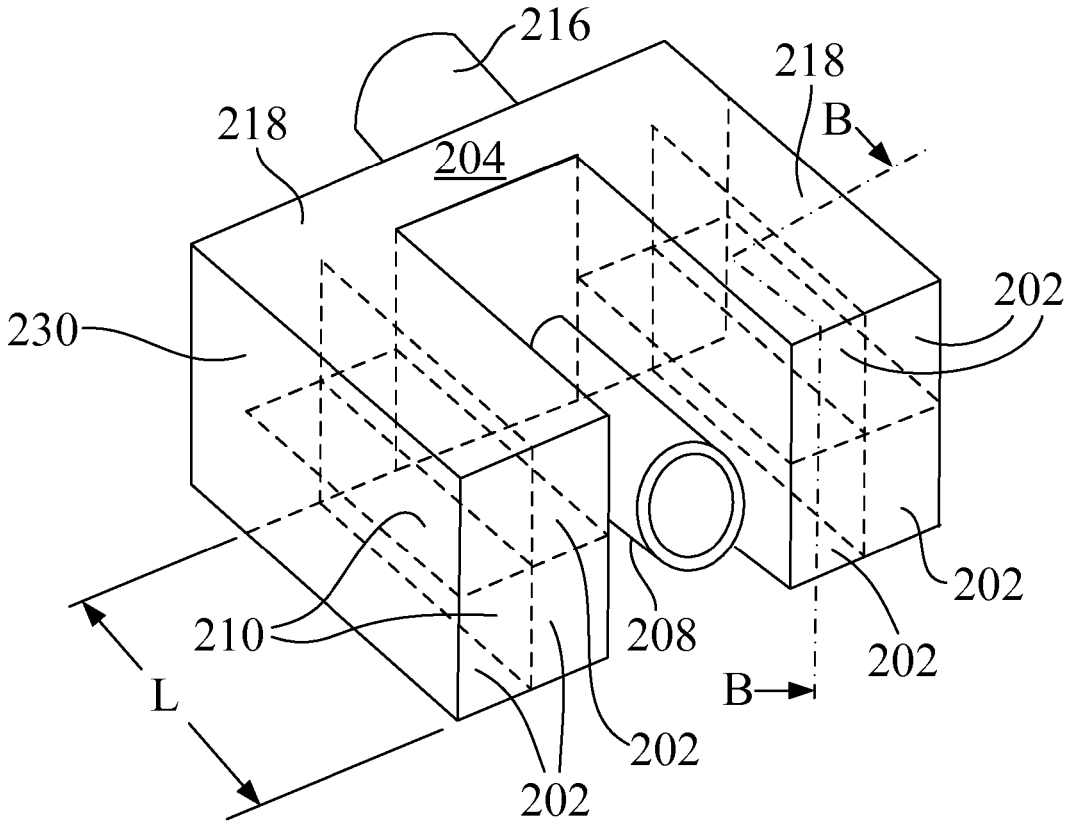
FIG. 2A. schematically illustrates another aspect of the invention in which the tuned acoustic chambers of FIG. 1 are realizing within a common housing, consistent with another aspect of the present invention.
Figure 2B:
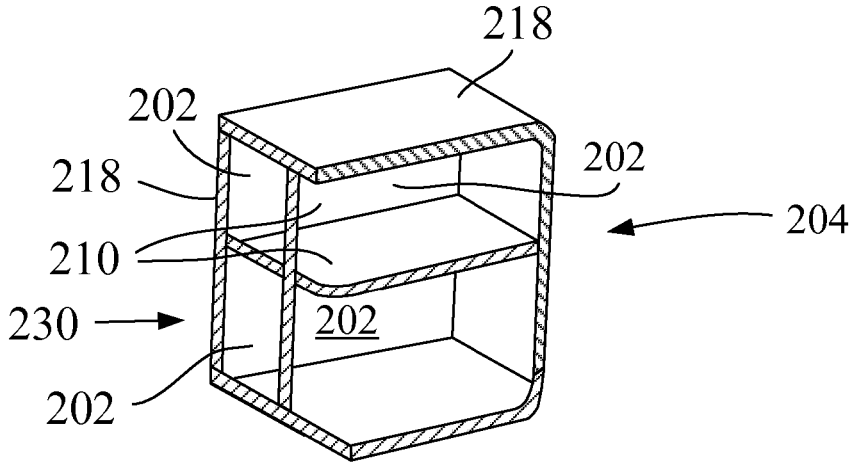
FIG. 2B illustrated a cutaway sectional view along B-B of FIG. 2A particularly depicting acoustic chamber sidewalls realized from support ribs within the enclosure of FIG. 2A.

FIGS. 2A and 2B schematically illustrate an alternate unitary embodiment of the acoustic attenuation device of FIG. 1 in which the enclosure 204 defining the intermediate chamber within is extended in portions outwards along the inlet channel 208 to provide space in the enclosure 204 for the acoustic chambers which are now realized as chambers 202 formed as unitary components within the now enlarged enclosure 204. Advantageously, support ribs 210 formed within the enclosure 204 and extending inwards from walls 218 of the enclosure are spaced and configured to define the side walls of the acoustic chambers 202. The tuned acoustic chambers of FIG. 1 may be realized as the acoustic chambers of FIG. 2A, but with the advantage that the acoustic chambers 202 are now realized as a structure molded within and together with the enclosure 204.

As can be seen in FIG. 2A, the length of the acoustic chambers is substantially the same length as the length of the inlet channel 208.

FIG. 2B is a cutaway sectional view along section lines B-B of FIG. 2A showing one possible internal arrangement of enclosure support ribs 210 that extend inwardly from the outer walls 218 of the enclosure 204 and intersect with or securely join to other walls or internal support ribs 210 to integrally form the acoustic chambers 202 within the interior of the enclosure 204.

In the case of a molded plastic enclosure 204, advantageously the molded plastic housing generally requires support ribs to support and strengthen the outer walls of the enclosure or housing for structural strengthening and the reduction of noise transmission, as discussed earlier. The ribs may be advantageously configured within the housing by arranging the support ribs 210 and sizing the ribs 210 to define the acoustic chambers 202 within the housing 204, with only minimal requirements for additional plastic material.

In FIG. 2A phantom lines illustrate one possible example configuration of the support ribs 210 defining acoustic chambers 202. As can be seen in FIG. 2A, the acoustic chambers 202 formed in the enclosure 204 are configured to have an axial length L substantially matching the length of the inlet air channel 208. Also illustrated is the enclosure 204 enclosing the intermediate chamber positioned in front of and in airflow communication with the open ends 230 of the acoustic chambers 202 and the mouth of the inlet channel 208 and outlet channel 216.

Figure 3A:
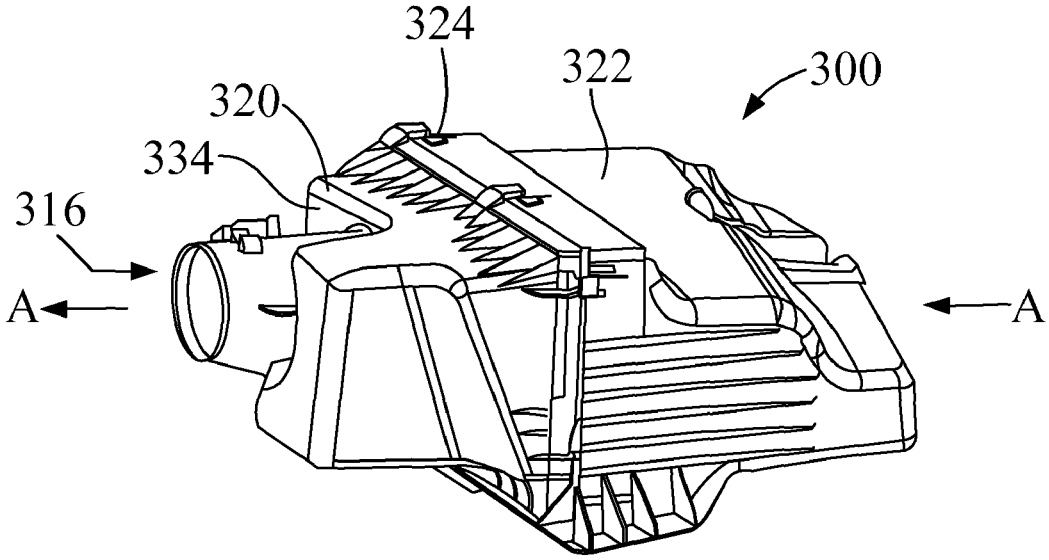
FIG. 3A illustrates an exemplary embodiment of a compact tuned acoustic device, consistent with the present invention.
Figure 3B:
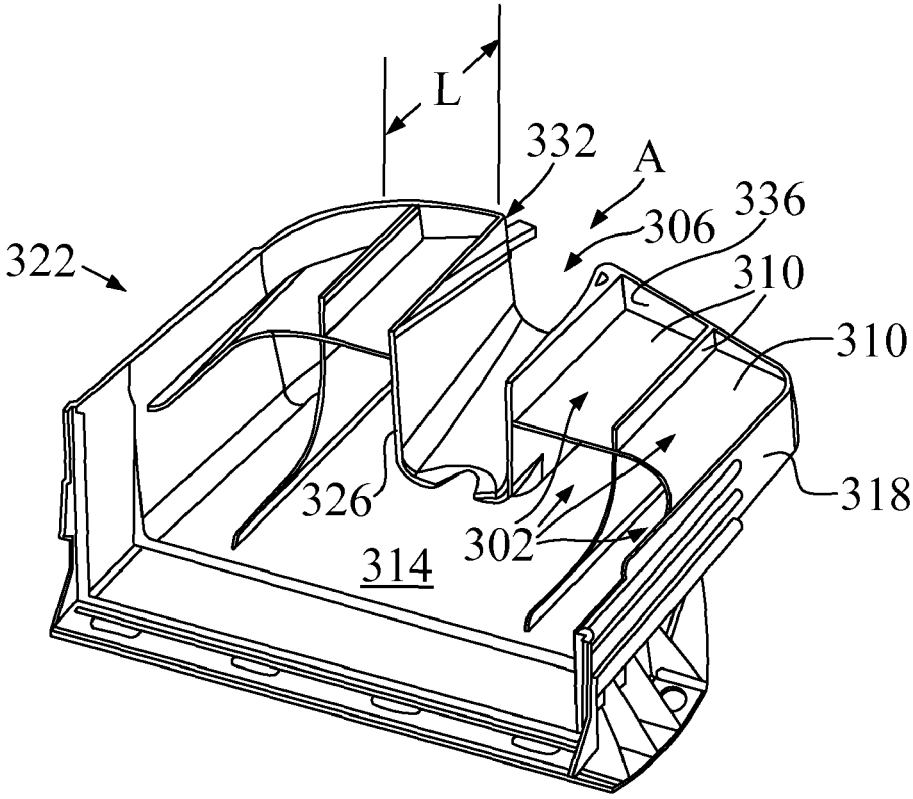
FIG. 3B illustrates a cutaway view of the acoustic chamber portion of the compact tuned acoustic device, illustrating general arrangement features and realization of acoustic chamber sidewalls from housing support ribs, consistent with the present invention.

FIG. 3A illustrates a particularly advantageous exemplary embodiment of a compact tuned acoustic device 300, consistent with inventive aspects discussed with FIGS. 1, 2A and 2B. FIG. 3B illustrates a cutaway view of the acoustic chamber portion 322 of the housing of the compact tuned acoustic device, illustrating general arrangement features and realization of acoustic chamber sidewalls from housing support ribs, consistent with the present invention.

The compact tuned acoustic attenuation device 300 is illustrated with a two piece housing realized as a mateable cover portion 320 and an acoustic chamber portion 322. The housing portions are preferably injection molded of a plastic resin material and are configured to closeably mate along complimentary configured flanges 324 to form a substantially air tight housing seal therebetween and form an air chamber within. A tubular air inlet channel 306 is formed on and extends through an end wall 332 of the acoustic chamber portion 322 of the housing. The air inlet channel 306 is substantially axially aligned with the air outlet channel 316 formed in an axially opposing end wall 334 in the cover portion 320 of the housing.

As can best be seen in FIG. 3B, the air inlet channel 306 protrudes into the acoustic chamber portion 322 of the housing 304 at a distance L. Support ribs 310 are secured to and extend inwardly from the outer walls 318 of the acoustic chamber portion 322 and cooperate to form a plurality of acoustic chambers 302. As can best be seen in FIG. 3B, the support ribs 310 define acoustic chambers 302 having open end portions substantially aligned with the mouth 326 of the air inlet channel 306, wherein the mouth 326 is defined as the end portion of the air inlet channel 326 opening into the intermediate chamber 314 such that the acoustic chambers 302 also protrude into the housing by a distance similar to the protrusion distance L of the air inlet channel 306.

The mouth 326 of the air inlet channel 306 and the mouth of the air outlet channel 316 are spaced apart at a distance defining an air gap therebetween. An intermediate chamber 314 is defined by the depth of the air gap and extends widthwise across the housing. The intermediate chamber 314 is arranged in the air gap between the mouth of the air outlet channel and the opposing mouth 326 of the air inlet channel 316 as well as the open ends of the acoustic chambers 302, placing the acoustic chambers 302 and inlet/outlet channels in air flow communication through the intermediate chamber 314.

As can be seen in FIGS. 3A and 3B, the acoustic chambers 302 are arranged within the housing in a substantially lateral (side by side) and parallel relationship to each other and also to the protruding air inlet channel 306. The open top ends of the acoustic chambers face and open into the intermediate chamber 314.

Each acoustic chamber 302 has a depth defined by the distance between the open end of the acoustic chamber and the bottom wall 336 of the acoustic chamber 302. Each acoustic chamber has a set of circumferentially joined sidewalls, which may be realized as support ribs and/or interior housing walls, with the side walls closed over by a bottom wall 336, the combination defining an acoustic volume for the quarter wave acoustic chamber.

By intentional provision and placement of the support ribs 310 defining the acoustic chamber sidewalls, each individual acoustic chamber 302 may have its acoustic volume and depth configured to provide a desired acoustic attenuation characteristic at a sound frequency selected for that acoustic chamber. The acoustic chambers may be configured to act together in combinations (as shown in FIGS. 3A and 3B) to have combined acoustic attenuation characteristics of differing tuned frequencies that cooperate to broaden the sound attenuation frequency bandwidth of the compact tuned acoustic attenuation device or to further increase the noise attenuation at selected frequencies (such as by tuning a plurality of acoustic chambers to the same tuned frequency to act together).

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

The invention claimed is:

1. A compact tuned acoustic attenuation device for an air induction system, comprising:

a housing enclosing and defining a housing chamber within, said housing including a first end wall of said housing;

a second end wall of said housing arranged on an opposing side of said chamber relative to said first end wall;

a tubular air inlet channel arranged on and extending through said first end wall into said chamber with an open mouth of said air inlet channel protruding into said chamber at a first distance from said first end wall;

an air outlet channel opening through said second end wall, said air outlet channel having an open mouth within said housing positioned to substantially face said open mouth of said air inlet channel, said inlet channel open mouth spaced at a second distance from said outlet channel to form an air gap therebetween, said second distance spacing placing said housing chamber in air flow communication with said inlet and outlet channels; and at least one acoustic chamber arranged within said housing chamber and positioned in a substantially lateral parallel relationship to said inlet channel at a position proximate to said first end wall, said at least one acoustic chamber enclosed by at least one side wall and a bottom wall defining an acoustic volume therein, said at least one acoustic chamber having an open end portion arranged facing said air gap in communication with said housing chamber, said at least one acoustic chamber having a depth defined by a distance between said bottom wall and said open end;

wherein each of said at least one acoustic chambers has at least one of its volume and depth selected to provide a desired acoustic attenuation at a selected frequency and bandwidth of noise entering said housing chamber; and wherein at least a portion of said at least one acoustic chambers are configured to operate as quarter wave tuners.

2. The tuned acoustic attenuation device of claim 1, wherein at least some of said at least one acoustic chambers each have a volume and depth selected to provide acoustic attenuation at the same or a differing selected frequency and bandwidth relative to other ones of said acoustic chambers; and wherein acoustic attenuation characteristics of said acoustic chambers cooperate to broaden the sound attenuation bandwidth or increase the attenuation at selected frequencies so as to selectively characterize sound in said acoustic attenuation device.

3. The tuned acoustic attenuation device of claim 1, wherein each of said acoustic chambers are tuned to different frequencies providing sound attenuation across a broad range of frequencies.

4. The tuned acoustic attenuation device of claim 1, wherein said acoustic chambers each have its respective depth selected to match said first distance of said inlet channel.

5. The tuned acoustic attenuation device of claim 1, wherein at least a portion of said side walls of some of said at least one acoustic chamber are internal walls secured to and extending from said walls defining said housing.

6. The tuned acoustic attenuation device of claim 5, wherein at least a portion of said acoustic chambers have side walls formed by housing support ribs secured to said housing defining walls, wherein said support ribs also serve as acoustic chamber sidewalls.

7. The tuned acoustic attenuation device of claim 1, wherein said bottom walls of said at least one acoustic chamber form substantially rigid reflection surfaces operable to reflect sound waves back through said at least one acoustic chambers and into said gap to at least partially attenuate sound energy having said acoustic chamber selected frequency.

8. A tuned acoustic attenuation device for an air induction system, comprising:

an enclosure defining an intermediate air chamber, said enclosure including a first end wall and an opposing second end wall;

a tubular air inlet channel arranged on said first end wall and opening through said first end wall into said intermediate chamber, said tubular air inlet having an axially arranged length L;

an air outlet channel opening through said second end wall into said intermediate chamber, an open end of said outlet channel positioned to substantially face an open end of said air inlet channel; and at least one acoustic chamber arranged on and extending outwards from said first end wall, said at least one acoustic chamber having an open end opening into said intermediate air chamber, said at least one acoustic chamber positioned in a substantially lateral parallel relationship to said inlet channel, said at least one acoustic chamber enclosed by at least one side wall and a bottom wall defining an acoustic volume therein, said at least one acoustic chamber having a depth defined by a distance between said bottom wall and said open end;

wherein said at least one acoustic chambers has its volume and depth selected to provide acoustic attenuation at a selected frequency and bandwidth of noise entering said housing chamber through said air outlet channel;

wherein at least a portion of said at least one acoustic chambers are configured to operate as quarter wave tuners;

wherein at least some of additional ones of said at least one acoustic chambers each have a volume and depth selected to provide acoustic attenuation at the same or a differing selected frequency and bandwidth relative to other ones of said acoustic chambers; and wherein acoustic attenuation characteristics of said acoustic chambers cooperate to broaden a sound attenuation bandwidth or increase sound attenuation at selected frequencies so as to selectively characterize sound in said acoustic attenuation device.

* * * * *